US006231429B1

(12) United States Patent
Lisec

(10) Patent No.: US 6,231,429 B1
(45) Date of Patent: May 15, 2001

(54) PROCESS FOR EDGING OF GLASS BLANKS THROUGH SIMULTANEOUS MACHINING OF PLURAL EDGES

(76) Inventor: Peter Lisec, Bahnhofstrasse 34, A-3363 Amstetten-Hausmening (AT)

( * ) Notice: Subject to any disclaimer, the term of this patent is extended or adjusted under 35 U.S.C. 154(b) by 0 days.

(21) Appl. No.: 09/203,378

(22) Filed: Dec. 2, 1998

(30) Foreign Application Priority Data

Dec. 2, 1997 (AT) ..... 2045/97
Sep. 1, 1998 (EP) ..... 98890257

(51) Int. Cl.[7] ..... B24B 1/00

(52) U.S. Cl. ..... 451/44; 451/53; 451/57; 451/190

(58) Field of Search ..... 451/41, 43, 44, 451/302, 53, 190, 449, 194, 57

(56) References Cited

U.S. PATENT DOCUMENTS 1,502,130 * 7/1924 St. Clair .
2,391,322 * 12/1945 Lundquist .
2,637,951 5/1953 White .
2,945,332 * 7/1960 Gury, Jr. .
3,800,477 4/1974 Jendrisak et al. .
4,528,780 * 7/1985 Halberschmidt et al. .
4,594,814 * 6/1986 Olszewski et al. .
4,658,550 * 4/1987 Myers et al. .
5,816,897 * 10/1998 Raeder et al. ..... 451/44

FOREIGN PATENT DOCUMENTS 21 22 990 7/1981 (DE) .
44 19 963 9/1995 (DE) .

* cited by examiner

*Primary Examiner*—Timothy V. Eley
(74) *Attorney, Agent, or Firm*—Young & Thompson

(57) ABSTRACT

A device for edging of glass panes (3) has at least one grinding head as the machining tool, consisting of two crossing belt grinders (10, 12) which simultaneously engage the edges of one border of the glass pane (3) to edge-finish these edges. The belt grinders (10, 12) are supported to swivel in the machine frame (1) so that from a readiness position into their [sic] they can be placed against the edges of one border of the glass pane (3) which is to be edged for example to remove burrs. Because the belt grinders (10, 12) are arranged to be adjustable, their position can be matched to glass panes (3) of varied thickness. When there are several grinding heads, glass panes (3) can be machined at the same time on several borders.

18 Claims, 8 Drawing Sheets

2
5
3
1
14
18
22
10
6
26
24
32
36
30
4
26
30
12
24
34
22
16

16
14
95
34
78
78
95
95
26
12
10
79
96
26
96
77
77

PROCESS FOR EDGING OF GLASS BLANKS THROUGH SIMULTANEOUS MACHINING OF PLURAL EDGES

The invention relates to a process with the features of the introductory part of claim 1. The invention furthermore relates to a device with which the process can be carried out.

Glass panes are cut by scratching and breaking to the desired size; this is generally done on so-called "glass cutting tables" and "breaking tables" assigned to them.

The glass panes obtained in this way have very sharp-edged borders with burrs; this is a disadvantage for subsequent handling of glass panes, for example, in the manufacture of insulating glass panes. On the on hand, there is the danger that the edges of the glass panes will break off and on the other hand there is the serious hazard that someone will be hurt on the sharp edges of the glass panes by cutting. In addition, the support and transport means (for example, delivery rollers or conveyor belts) which engage the edges of the glass panes are subject to heavy wear by the unworked edges of the glass panes.

The object of the invention is to make available a process and a device for edging the borders of the glass panes, with which the glass panes can be worked such that their borders are no longer sharp, in particular have no burrs.

This object is achieved with respect to the process first of all with the features of the independent main process claim and with respect to the device first of all with the features of the independent main equipment claim.

Preferred and advantageous embodiments of the process as claimed in the invention and the device as claimed in the invention are the subject matter of the subclaims.

Since in the process as claimed in the invention the machining tools used for edging engage both edges of one border of a glass pane at the same time, compared to an approach in which only one edge of a border is machined, therefore edged and deburred, not only is worktime saved, but it also results in that significant forces do not act on the glass pane transversely to its plane, so that it is possible to hold the glass pane or move it in a controlled manner using simple means when it is being edged. Short cycle times are also achieved.

The process as claimed in the invention can be carried out in different ways. Thus, for example it is possible to edge all four borders of a glass pane on both sides in succession, for which the glass pane is turned after edging the edges of one border, for example around an axis perpendicular to its plane until the next border of the glass pane with edges to be edged is in the machining position.

The process as claimed in the invention in one embodiment makes it possible to edge several borders of a glass pane at the same time; this is especially preferred for rectangular or square panes. Thus for example it is possible to proceed such that first of all, for example in glass panes standing essentially vertical, the edges of the vertical border which is the front one in the direction of motion, then those of the upper horizontal border, then those of the vertical border which is the rear one in the direction of motion, and finally the edges of the lower horizontal border of the glass pane are edged.

An approach is also conceivable in which edging of the edges of the lower horizontal border of the glass pane is done first and then one vertical border, further the upper horizontal border and finally the second vertical border are edged.

Further acceleration of the edging of glass panes in the area of the edges on their borders can be done by providing several machining sites for edging. For example, it is possible to proceed with two machining sites such that in one machining site with an edging tool the front vertical border and then the rear vertical border of the glass pane are worked in succession and in a second machining site with two machining tools, for example, at the same time, the edges of the top and the bottom horizontal border of the glass pane are edged.

One especially efficient and high speed embodiment of edging of glass panes using the process as claimed in the invention arises when with a (single) machining tool in a first machining site the vertical border of a glass pane which is the rear one in the direction of motion and the border of a following glass pane which is the front one in the direction of motion are worked at the same time. Preferably then the first of the two glass panes (therefore the one with the vertical border which is the rear one with reference to the conveyor direction has already been machined—its front border was already machined beforehand) is conveyed to a second machining site in which with two machining tools in a continuous process and essentially at the same time the upper and the lower horizontal border of the glass pane is edged. In this approach the glass pane which was machined in the first machining site jointly with the preceding glass pane in the area of its vertical border which is the front one relative to the direction of passage continues to move in the first machining site until the machining tool of the first machining site is assigned to its border which is the rear one in the direction of motion and then stopped until the next glass pane has been delivered, whereupon its vertical edge which is the rear one relative to the passage direction is edged jointly with the front vertical edge of the next glass pane.

Alternatively, within the framework of the invention it is also possible to proceed such that in one machining site at the same time first the two vertical borders of one glass pane are edged, in which for example one of the grinding tools provided for this purpose can move from bottom to top and the other from top to bottom, and that subsequently the two horizontal borders, therefore the top and the bottom horizontal border of the glass pane, are edged at the same time in the continuous process. This embodiment of the process as claimed in the invention can be carried out in two machining sites with four machining tools.

All embodiments of the process as claimed in the invention are carried out preferably, but not exclusively, with glass panes aligned vertically or essentially vertically during machining of the borders of the glass panes. Working with vertically aligned glass panes has the advantage that the process as claimed in the invention and the device provided for this purpose can be easily integrated into systems for producing insulating glass panes which work almost exclusively with vertically aligned glass panes or insulating glass panes. Then it is no longer necessary to tilt into a horizontal position the glass panes with borders to be edged using the process as claimed in the invention or in the device as claimed in the invention when they are removed from storages for glass blanks (for example, compartmented trucks) to be machined using the process as claimed in the invention or in the device as claimed in the invention. In addition, the edged glass panes need no longer be re-aligned into the vertical or essentially vertical position when they are supplied for example to a glass plate washing machine. Nevertheless the process as claimed in the invention can also be carried out when the glass panes are aligned horizontally. This can be an advantage for example when glass panes are edged immediately after having been cut to size from glass slabs on a glass cutting system using the process as claimed in the invention.

A device suitable for executing the process as claimed in the invention works for example with (at least one) machining tool which has belt grinding means arranged crosswise which engage the two sides of one border at the same time in order to break, therefore to edge the edges of the borders of the glass pane, and to remove sharp burrs.

When the device as claimed in the invention has a single machining tool with a pair of belt grinders, the four borders of the glass pane are machined in succession, the glass pane, after one border has been machined, being turned by 90° and then the next border being machined by the pair of belt grinders and so forth until all (four) borders of the glass pane have been machined.

This turning of the glass pane by 90° (around an axis perpendicular to its plane) can be done by hand from or with a turning device of any type, for example a suction device, a pair of suction devices or a gripper which engages the border of the glass pane.

In one embodiment the device has machining tools with one pair of crossed belt grinders each, one machining tool machining the lower horizontal border of the insulating glass pane and the second machining tool which is adjustably (up and down) mounted in the device machining the vertical borders of the glass pane.

If the adjustably mounted machining tool can additionally be swivelled around an axis perpendicular to the glass plane, it can also be used for machining the edges on the upper horizontal border of the glass pane by moving the latter under it.

In this embodiment of the device as claimed in the invention it is possible to proceed such that the adjustable machining tool first machines the front border which is vertical relative to the direction of movement of the glass pane, the latter being stationary, whereupon then the lower machining tool machines the lower border and the adjustable machining tool after it is swivelled by 90° machines the upper border of the glass pane, the latter being moved preferably through between the machining tools. Finally the adjustable machining tool machines the border of the glass pane which is the rear border in the direction of motion after swivelling again by 90°.

In principle one embodiment of the device as claimed in the invention is possible with only one adjustably mounted machining tool which can be swivelled around an axis which is perpendicular to the plane of the glass pane, with a pair of crossing belt grinders which machines all four borders of the glass pane in succession.

Furthermore, embodiments of the device as claimed in the invention are known with more than two machining tools, for example an embodiment with four machining tools, in which embodiment each machining tool machines only one border of the glass pane.

In one especially preferred embodiment of the device as claimed in the invention, there are two machining sites which are accommodated for example in a common housing, in the first machining station there being a machining tool with a pair of crossing belt grinders, which is guided to be adjusted up and down along the guide rail in order to edge the vertical borders of the glass panes. Preferably this vertically adjustable machining tool of the first machining site is located in the area of an interruption of the conveyor device provided in the device so that it can be lowered into the readiness position below the level of the conveyor device to avoid hindering transport of glass panes. In the second machining site there are two machining tools with crossing belt grinders, one working at the height of the conveyor device, in order to edge the lower horizonal border, and the second located at an adjustable distance over the conveyor means in order to edge the upper horizontal border of the glass pane which is moved through between the machining tools.

The conveyor device is preferably divided into several sections, each conveyor unit consisting of a continuous conveyor belt on which the glass panes stand with their lower border, and two continuous conveyor elements which engage the glass panes in the area of the lower horizonal border from the two sides. The opposite continuous conveyor elements which engage the glass surfaces can be equipped with pressure jaws to achieve good frictional contact with the glass panes.

Additionally or alternatively, for reliable delivery and positioning of glass panes in the device and for reliable transport of the glass pane while it is being worked by edging, there is a pulling device which engages the glass panes. For example, this pulling device is a vacuum-operated device, for example a vacuum chuck, which can be moved in the device as driven in the direction of motion.

Other details and features as well as advantages of the process as claimed in the invention and the device as claimed in the invention follow from the following description of embodiments of the invention.

Figure 1:
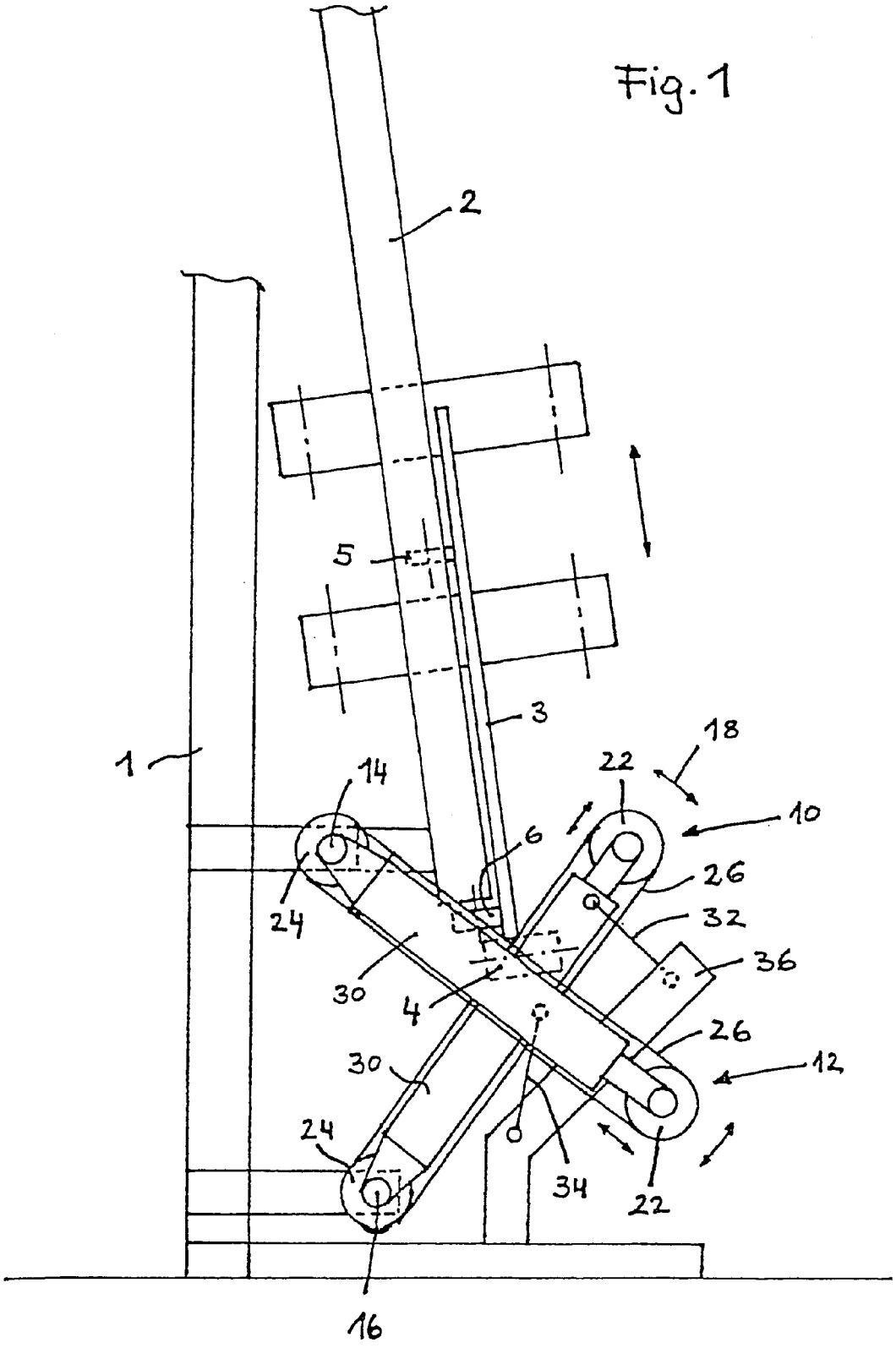
FIG. 1 shows in a side view in schematic form a device for edging of glass panes.
Figure 2:
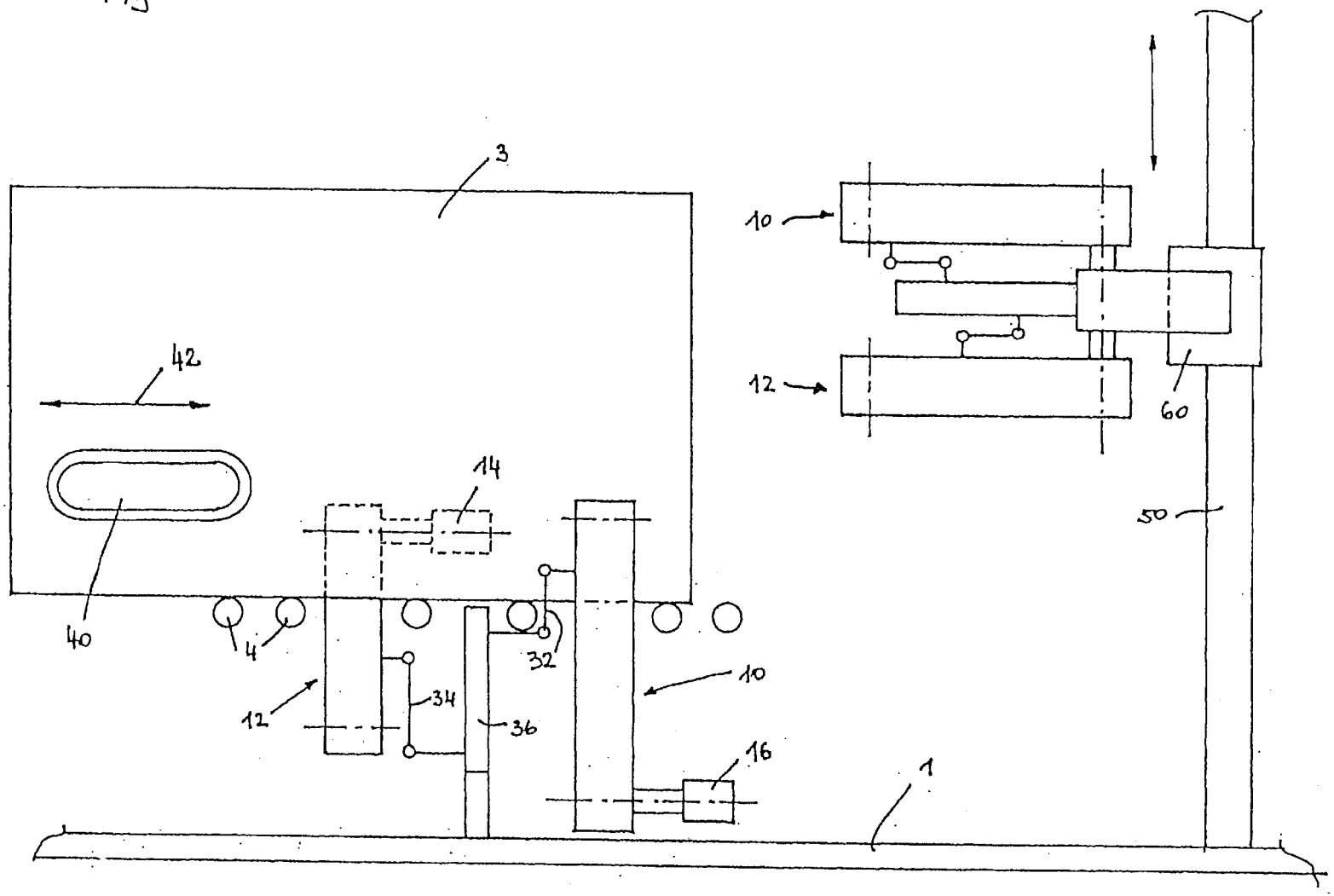
FIG. 2 shows the device from FIG. 1 from the right of FIG. 1, some components of the device not being shown.

The embodiment shown in FIGS. 1 and 2 has a frame 1 on which a support wall 2 is mounted for a glass pane 3 to be machined. The support wall 2 is tilted in this embodiment vertically to the rear so that a glass pane 3 can be transported leaning on it. For transport of the glass pane 3 and to support it from underneath in the area of the bottom edge of the support wall 2 there is a series of conveyor rollers 4 or a similar conveyor device, for example an optionally subdivided conveyor belt. On the support wall 2 the glass pane 3 is guided by several freely rotatable support rollers 5, one row of support rollers 6 being provided between the conveyor rollers 4 and the lower edge of the support wall 2. Thus the glass pane 3 is reliably guided especially on its lower border. In place of the described support wall 2 there can be a roller section or an air cushion wall to support the glass panes 3 laterally.

Anywhere on the lower border of the support wall 2 there is a machining tool (grinding head) with a pair of belt grinders 10 and 12. The belt grinders 10 and 12 are supported to swivel in the machine frame 1 around axes 14 and 16 which lie behind the support wall 2 (arrows 18 and 20). Each belt grinder 10, 12 has two deflection rollers 22 and 24 for a continuous grinding belt 26. Between the sides of the grinding belt 26 a hydraulic cylinder 30 is held which is supported to swivel on bearings 14 and 16 and which carries a deflection roller 22 so that the grinding belts 26 can be tensioned by acting on the hydraulic cylinder 30.

To swivel the hydraulic cylinder 30 and thus the belt grinders 10 and 12 in order [sic] them from their readiness position into their working position in which their grinding belts 26 engage the lower horizontal border of the glass pane 3, therefore the border which stands on the conveyor rollers 4, one actuating cylinder 32 and 34 supported in the machine frame 1 is assigned to each of the hydraulic cylinders 30. These actuating cylinders 32 and 34 are supported in the embodiment shown in FIG. 1 on an arm 36 which is attached in the machine frame 1 and are shown only schematically. It is apparent that the grinding belts 26 in their working position are aligned such that their sides which act on the lower border of the glass pane 3 include with one another an angle of roughly 90°, therefore cross one another.

A drive motor which is not shown is assigned to one of the deflection rollers 22, 24, preferably the deflection rollers 24 in the area of the bearing points 14 and 16 in the machine frame 1 in order to drive the grinding belts 26 when the device is used to edge-finish the edges of the borders of the glass panes 3 to remove burrs from them. In doing so the grinding belts 26 are preferably driven such that they run in opposite directions in the area in which they engage the lower border of the glass pane 3, especially in the representation of FIG. 1 at their crossing point in which the border of the glass pane 3 to be machined is held, they run at one another.

As FIG. 2 shows, there can be a pulling device 40 for the glass pane 3 to be machined. This pulling device 40 in the simplest example is a suction device to which negative pressure can be applied and which thus abuts the surface of the glass pane 3 to be machined, that is, the surface facing away from the operating side of the device (on the right in FIG. 1), therefore the rear surface. The suction device of the pulling device 40 can be moved by means, which are not detailed, in the machine frame 1 (arrow 42) so that it can not only pull the glass pane 3, therefore it supports the transport of the glass pane 3 by the conveyor rollers 4 which engage the lower edge of the glass pane 3 and on which it stands, but also by stopping the drive means for the suction device the glass pane 3 is held stationary when this is necessary for example when machining the edges of the vertical borders of the glass pane 3.

It is apparent that with the device shown in FIGS. 1 and 2, if it has only one machining tool with a pair of belt grinders 10, 12 which are located in the area of the lower edge of the support wall 2, the glass pane 3 can be machined in a continuous process only in the area of its lower border which lies on the support rollers 4. As soon as one border has been completely ground, the glass pane 3 in this embodiment is turned by 90° either by hand or using a turning device so that the next border to be machined stands on the conveyor rollers 4 and can be machined. This is continued until all borders of the glass pane 3 have been edged.

When turning of the glass pane 3 is to be avoided, in the device as claimed in the invention there can be more than one machining tool with a pair of belt grinders 10, 12. This is shown for example in FIG. 2 where another machining tool is provided with a pair of belt grinders 10, 12 which is mounted on a carriage 60 which can be moved on a guide rail 50. This machining tool with one pair of belt grinders 10, 12 can be assigned to the vertical edges of a glass pane 3 to be machined, in order to edge it. In addition, the pair of belt grinders 10, 12 located on the carriage 60 can be swivelled around an axis which is aligned perpendicular to the plane of the support wall 2 and thus perpendicular to the plane of the glass pane 3. This machining tool with a pair of belt grinders 10, 12 can then be aligned such that the belt grinders 10, 12 can machine the upper horizontal edge of the glass pane, while the glass pane 3 is moved through under it. In this mode of operation it is also possible to machine the lower horizontal and upper horizontal border of a glass pane 3 at the same time.

To equalize the wear of the grinding belts 26 of the belt grinders 10, 12, the pressure with which the belt grinders 10, 12 are placed against the border of the glass pane 3 to be machined can be increased. Alternatively or additionally, the peripheral speed of the grinding belts 26 can be increased, Furthermore, if necessary, additionally to one or both of the aforementioned measures the relative speed between the belt grinders 10, 12 and the glass pane 3 can be reduced to equalize the wear of the grinding belts 26.

In any case there can be nozzle arrangements from which a liquid which supports edging can be sprayed onto the grinding belts 26 and/or the just worked border of a glass pane 3.

Figure 3:
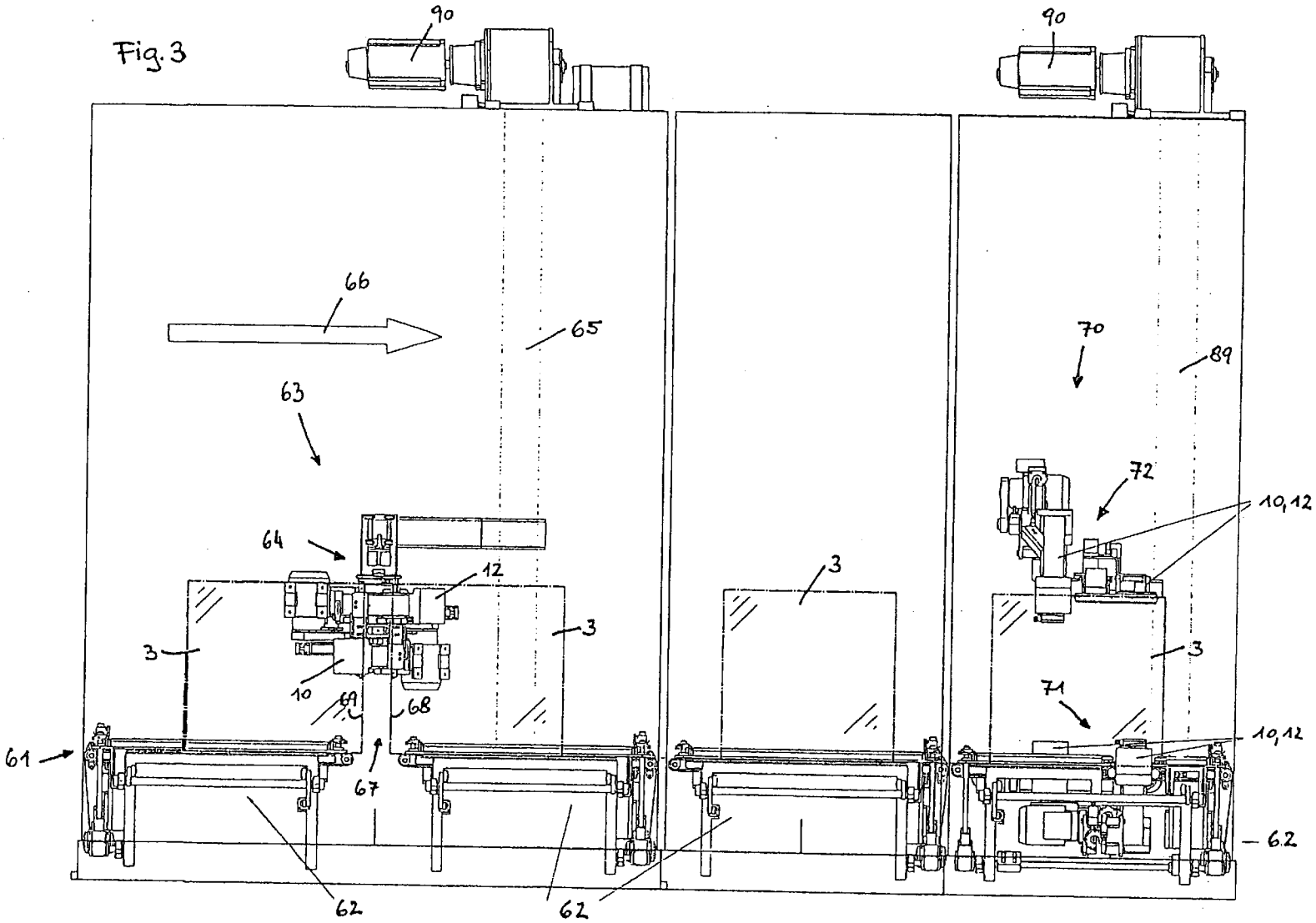
FIG. 3 shows in one view a device with two machining sites for edging of the glass panes.

The device shown in FIG. 3 for edge-finishing the edges of the borders of glass panes has a housing 60 in which underneath there is a conveyor means 61 which is divided into four transport units 62. In a first machining site 63 in which there are two of the four transport units 62, there is a grinding head 64 with two crossing belt grinders 10 and 12 as the machining tool and it is guided to move up and down on a vertical guide rail 65 perpendicular to the passage direction (arrow 66), therefore in the embodiment shown in FIG. 3.

In the second machining site 70 which is provided in the area of the transport unit 62 which is the last one viewed in the passage direction (arrow 66), as machining tools there are two grinding heads 71, 72 which are designed to machine on the one hand the lower horizontal border and on the other hand the upper horizontal border of one glass pane 3.

Figure 4:
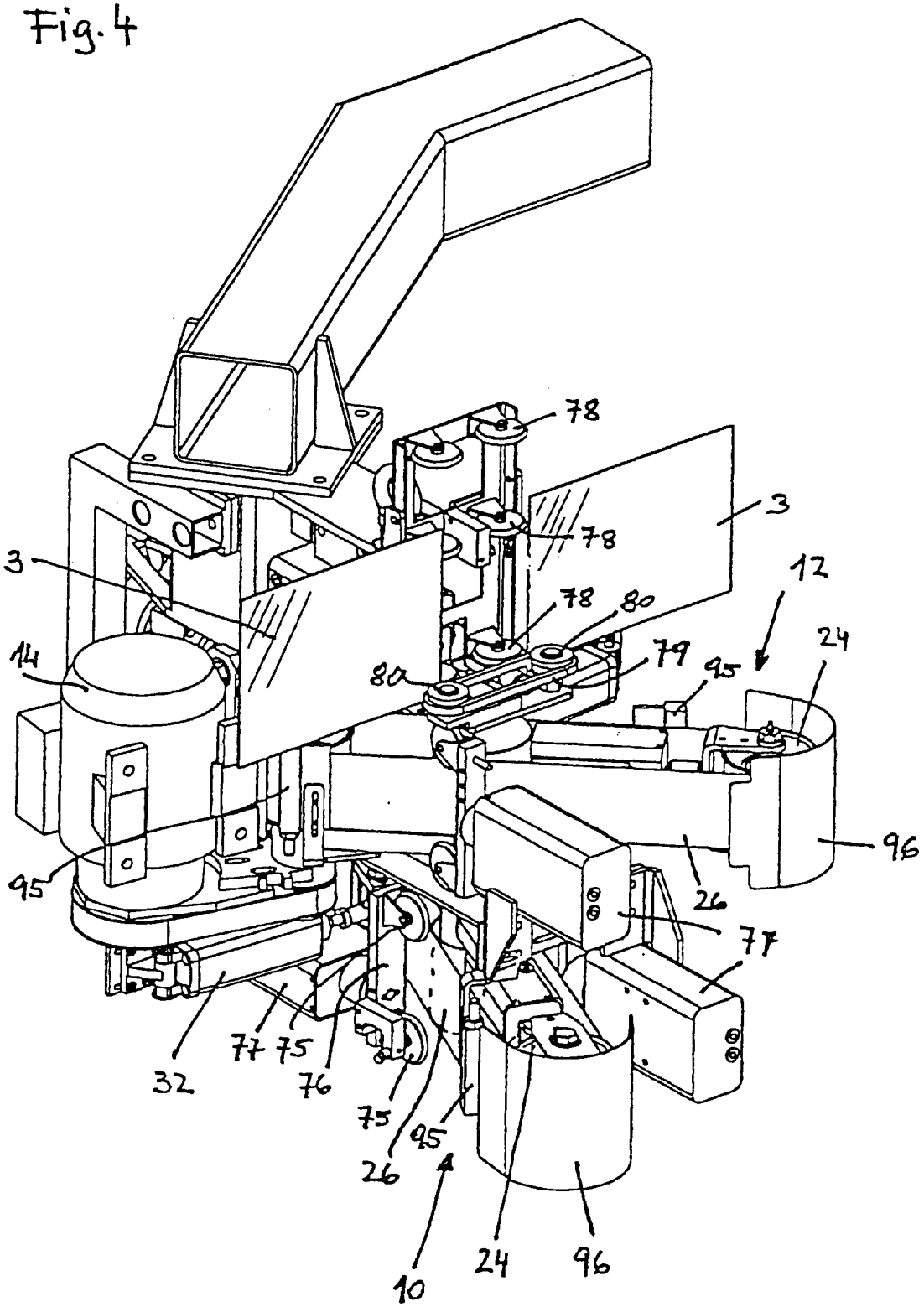
FIG. 4 shows in an oblique view the machining tool (grinding head) of the first machining site.
Figure 5:
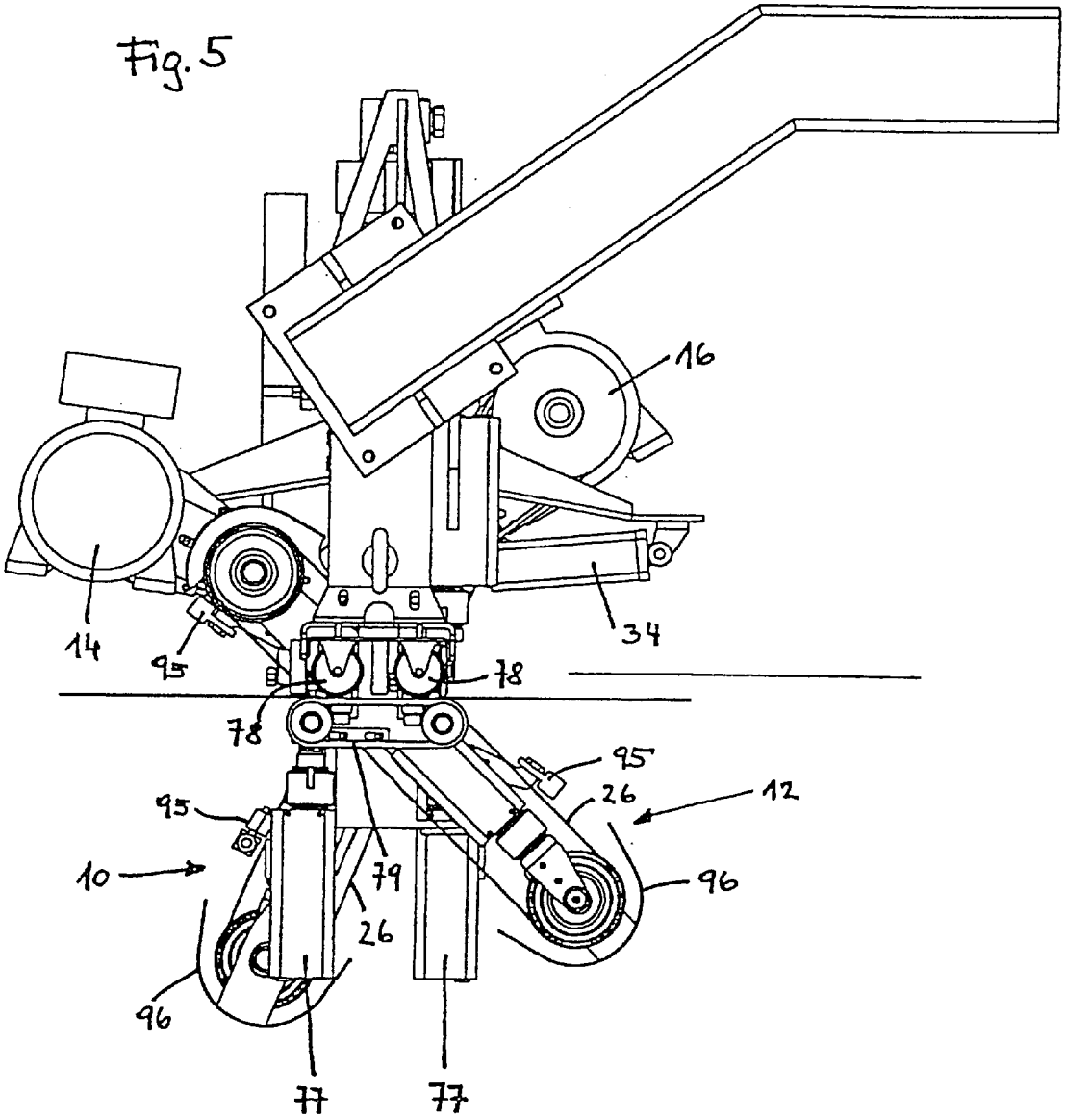
FIG. 5 shows an overhead view of the machining tool from FIG. 4.

Details of the construction of the grinding head 64 which can be adjusted up and down and which is provided in the first machining site 63 are shown in FIGS. 4 and 5. There it is apparent that one drive motor 16, 14 at a time is assigned to the grinding belts 26 of the belt grinders 10, 12 and is coupled to one of the deflection rollers 24 for the grinding belts 26.

In particular, FIG. 5 shows how the two glass panes 3 machined at the same time on the edges of the vertical borders facing one another are assigned to the grinding head 64 when the latter, as is apparent from FIG. 3, is moved up by the grinding belts 26 which extend through the free space 67 between the two glass panes 3 and in doing so machines the edges of the vertical border 68 of the one glass pane 3 which is the rear border relative to the passage direction and at the same time machines the edges of the vertical border of the following glass pane 3 which is the front border relative to the passage direction. The mutual assignment of the two glass panes 3 and the grinding head 64 is thus apparent from FIGS. 4 and 5.

To guide the grinding head 64 along the glass panes 3 there are rollers 75 which can be placed against the glass panes 3 and which are held on supports 76 to rotate freely around the horizontal axes; the supports can be actuated for their part by the hydraulic cylinders 77.

When the vertical grinding head 64 is in its readiness position, therefore underneath the conveyor path 61 formed by the transport units 62, the glass panes 3 are guided by support rollers 78 which can rotate freely around vertical axes on one side and on the other side by a continuous guide belt 79 which is placed around two rollers 80 which can rotate around vertical axes.

It is also shown in FIG. 4 that the continuous grinding belts 26 are supported from the inside by support rollers 81 in the area in which the belts engage the vertical borders 68, 69 of the glass panes 3 to be machined, so that the necessary contact pressure can be applied even without excess tensioning of the grinding belts 26 using the hydraulic cylinders 30 which engage the deflection rollers 24.

Figure 6:
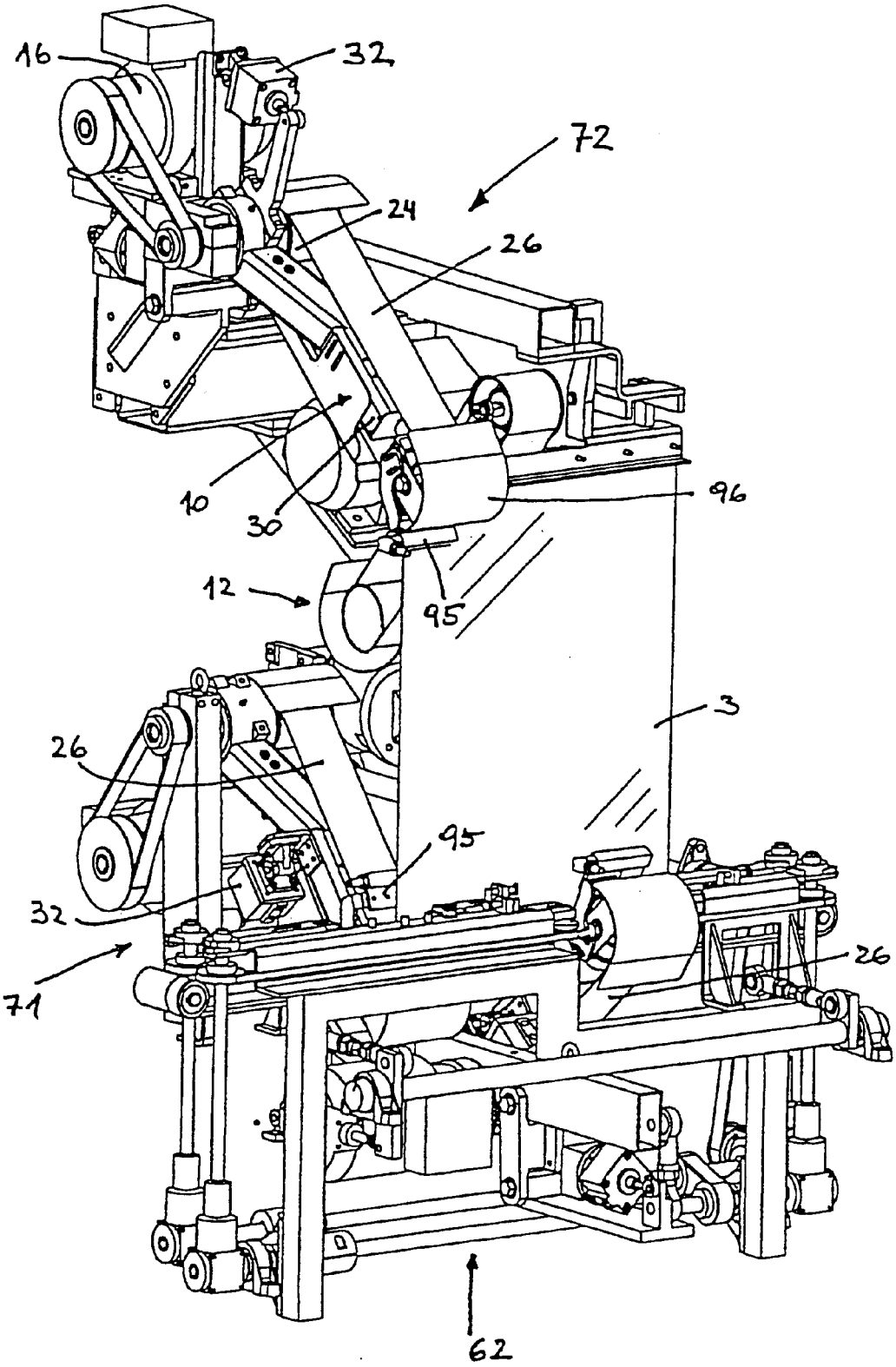
FIG. 6 shows in an oblique view the machining tools (grinding heads) located in the second machining site.
Figure 7:
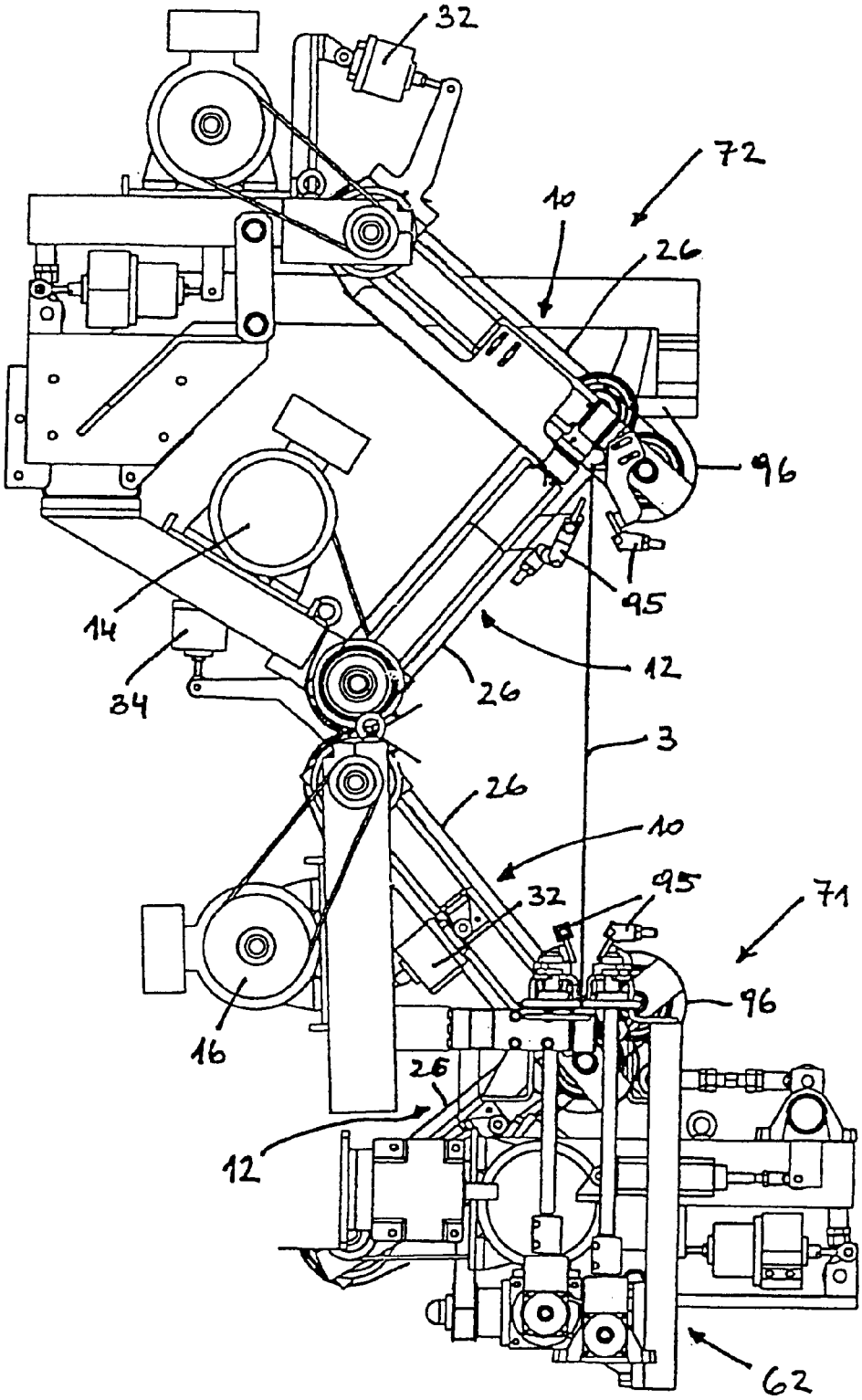
FIG. 7 shows in a side view the machining tools from FIG. 6.

FIGS. 6 and 7 show the two grinding heads 71, 72 which are provided as machining tools in the second machining site 70 and which machine the upper horizontal edge and the lower horizontal edge of one glass pane 3 at the same time in a continuous process in order to edge-finish its edges with the objective of removing burrs and the like.

Here the belt grinders 10, 12 of the lower grinding head 71 are held in an interruption in the last transport unit 62, as is shown especially in FIG. 6.

The upper grinding head 72, therefore the one of the grinding heads with belt grinders 10, 12 which are assigned to the upper horizontal border of the glass pane 3, is guided to be adjusted up and down on a vertical guide rail 89 in order to be able to align it according to the height of the glass pane 3. Thus, as for the grinding head which is provided in the first machining site 63 and which is moved vertically on the guide rail 65 when it edges the borders of the glass panes 3, a drive motor 90 which is located on the upper end of the guide rail 89 is used to move the grinding head 72.

The two crossing belt grinders 10, 12 of the upper grinding head 72, as shown in FIG. 6, using hydraulic motors 32, 34 can be moved into their working position which adjoins the upper border of the glass pane 3, these hydraulic motors 32, 34 engaging via levers the supports for the grinding belts 26 and the clamping cylinders 30. This can be seen in FIG. 7.

FIGS. 6 and 7 show nozzle arrangements 95 with which at the sites on which the grinding belts 26 engage the borders of the glass panes 3, a (flushing) liquid which supports edging can be supplied. These nozzles are also provided in the grinding head 64 of the first machining site 63, that is, the head which can be moved vertically up and down. Preferably the nozzles of the nozzle arrangements 95 are aligned such that the (flushing) liquid emerges from the nozzles roughly parallel to the side of the grinding belts 26 which moves past on the respective nozzle arrangement 95 and in the direction of motion thereof. Thus the (flushing) liquid reliably reaches the area in which the belt grinders 10, 12 machine the edges of the borders of the glass panes 3.

Figure 8:
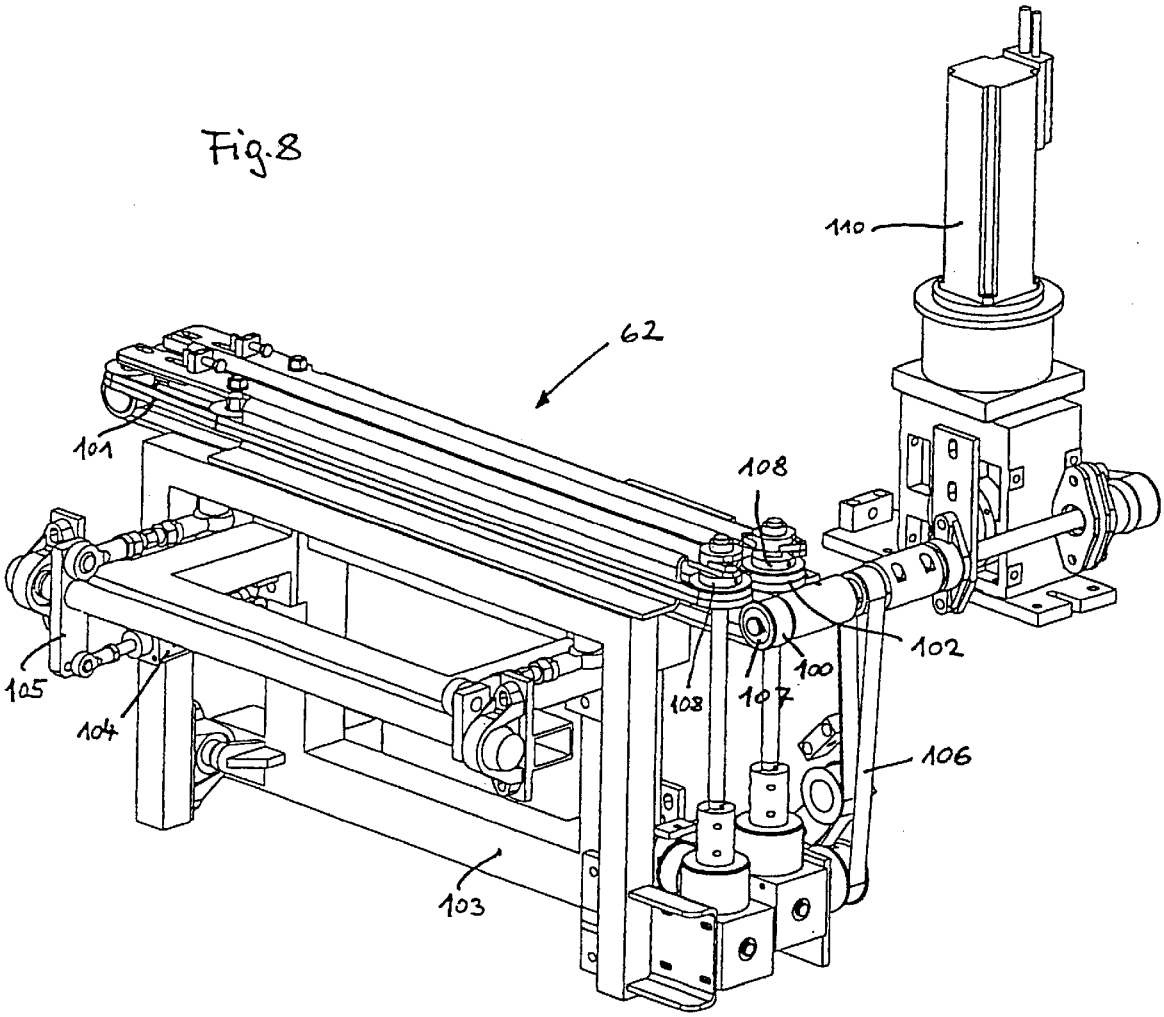
FIG. 8 shows in an oblique view one embodiment for a transport unit which engages the lower border of the glass pane to be edged.

In the example shown in FIG. 8 for a transport unit 62 the latter has a continuous conveyor belt 100 on which stands the lower horizontal border of the glass pane 3 to be edged and transported. Furthermore, there are two continuous conveyor elements 101, 102 which engage the two side surfaces in the area of the border of the glass pane 3. One of the two continuous conveyor elements 101 can be adjusted in the frame 103 of the transport unit 62 using a hydraulic motor 104 and a lever arrangement 105 so that the distance between the two continuous conveyor elements 101, 102 which transport the glass pane 33 by clamping between each other is set to the respective glass thickness and the required contact pressure for conveying the glass panes 3 without slip can be applied. Preferably the continuous conveyor elements 101, 102 are equipped with pressure jaws which engage the glass panes 3 by friction. All conveyor belts 100, 101, 102 are driven by a common drive motor 110 and a transmission 106 by which the outlet-side deflection rollers 107, 108 of the continuous conveyor belt 100 and the two lateral continuous conveyor elements 101, 102 are driven.

When nozzle arrangements 95 for applying the liquid which supports edging are assigned to the grinding heads 64, 70, 71 or their belt grinders 10, 12 it is recommended that the grinding belts 26 in the area of the deflection rollers 22, 24 be covered by protective sheets 96 in order to prevent excess spraying of liquid. Especially when there are nozzle arrangements 95 is the housing 60 with an interior accessible by doors advantageous.

In all embodiments of the process as claimed in the invention, especially the described embodiments, and likewise in all embodiments of the device as claimed in the invention, especially the described embodiments, the process is preferably as follows at the start and the end of edge-finishing the edges on one border of a glass pane:

At the start of movement of one glass pane relative to at least one grinding head with a pair of belt grinders, if therefore the glass pane is accelerated from rest to the transport speed, the grinding belts of the belt grinders with contact pressure which increases during the acceleration phase of the glass pane are pressed against the glass pane border to be machined. Additionally or alternatively the speed with which the grinding belts of the belt grinders are moved during the acceleration phase to the speed with which the grinding belts of the belt grinders are moved during edging can be increased.

When the belt grinders approach the end of the border of one glass pane to be machined, and thus the speed with which the glass pane is moved relative to the grinding head or the grinding heads is reduced, the speed with which the grinding belts of the belt grinders are moved can be reduced and/or the contact pressure with which the grinding belts are pressed against the edges of the machined border or the glass pane can be reduced.

These measures ensure that on the one hand the grinding belts at the start and end of an edging process are not unduly loaded and damage to the machined glass panes is prevented.

The described changing of the contact pressure of the grinding belts of the belt grinders and/or the speed with which the grinding belts of the belt grinders are moved, therefore the increase of the contact pressure and/or the speed of the grinding belts at the start of an edging process and the reduction of the contact pressure and/or the speed of the grinding belts at the end of a edging process is preferably also used when a grinding head moves along at least one border of at least one glass pane which is moved, aligned transversely to the transport direction of the glass pane, especially runs vertically or essentially vertically, as is the case for example in the machining site 63 with the grinding head 64.

In the simplest case the flushing liquid delivered from the nozzle arrangements 95 is water. Supplying the flushing liquid, especially water, is recommended particularly when diamond grinding belts are used as the grinding belts. When grinding belts are used which are provided with silicon carbide or another abrasive material, supplying flushing liquid is recommended, but not absolutely essential.

In summary, one embodiment of the invention can be described by way of example as follows.

A device for edging of glass panes 3 has at least one grinding head as the machining tool, consisting of two crossing belt grinders 10, 12 which simultaneously engage the edges of one border of the glass pane 3 to edge-finish these edges. At least one of the belt grinders 10, 12, but preferably both belt grinders 10, 12, are supported to swivel in the machine frame 1, so that from a readiness position into their [sic] they can be placed against the edges of one border of the glass pane 3 which is to be edged for example to remove burrs. Because at least one of the belt grinders 10, 12 is arranged to swivel, the location of the grinding belts of the belt grinders 10, 12 can be matched to the glass panes 3 of varied thickness. When there are several grinding heads, glass panes 3 can be machined at the same time on several borders

What is claimed is:

1. A process for preparation of glass panes for producing flat glass panes or insulating glass panes, including the steps of:

providing a said glass pane having a plurality of borders, each said border having two edges; and for each said border, simultaneously machining said two edges while the glass pane is oriented essentially vertically;

wherein the edges of opposing said borders of the glass pane are simultaneously machined; and wherein the edges being machined are perpendicular to a transport direction of the glass pane.

2. Process as claimed in claim 1, wherein the borders of the glass panes are machined while the glass panes are stationary.

3. Process as claimed in claim 2, wherein vertical edges of one glass pane are machined by moving two machining tools along the vertical edges with the glass pane stationary.

4. Process as claimed in claim 3, wherein the machining tools are moved from bottom to top.

5. The process of claim 1, wherein the transport direction of the glass panes is horizontal.

6. A process for preparation of glass panes for producing flat glass panes or insulating glass panes, including the steps of:

providing a said glass pane having a plurality of borders, each said border having two edges; and for each said border, simultaneously machining said two edges while the glass pane is oriented essentially vertically;

wherein two said glass panes are provided, and the edges of adjacent said borders of said two glass panes located next to one another in one plane, the borders being arranged perpendicular to a transport direction of the glass panes, are simultaneously machined with one machining tool.

7. Process as claimed in claim 6, wherein the two edges are machined by moving said one machining tool in a free space between the two glass panes.

8. Process as claimed in claim 7, wherein the adjacent borders are aligned essentially vertically and wherein the machining tool is moved between the adjacent borders from bottom to top during machining.

9. A process for preparation of glass panes for producing flat glass panes or insulating glass panes, including the steps of:

providing a said glass pane having a plurality of borders, each said border having two edges; and for each said border, simultaneously machining said two edges while the glass pane is oriented essentially vertically;

wherein the edges of the borders of the glass pane are machined by belt grinders with continuous grinding belts.

10. Process as claimed in claim 9, wherein planes of contact portions of belts of the belt grinders cross in an area of a plane of the glass pane.

11. Process as claimed in claim 10, wherein the contact portions of the grinding belts, viewed in a direction of movement of said contact portions, move towards one another in front of sites at which said grinding belts engage the borders of the glass pane.

12. Process as claimed in claim 9, wherein at a start of movement of one said glass pane relative to the belt grinders a speed with which the grinding belts of the belt grinders are moved and a pressure with which the grinding belts are pressed against the edges of one said border of said glass pane is increased, while relative speed of motion of the glass pane relative to the belt grinders is increased.

13. Process as claimed in claim 9, wherein at an end of movement of one said glass pane relative to the belt grinders a speed with which the grinding belts of the belt grinders are moved and a pressure with which the grinding belts are pressed against the edges of one said border of the glass pane is reduced, while a relative speed of motion of the glass pane relative to the belt grinders decreases.

14. Process as claimed in claim 9, wherein diamond grinding belts or silicon carbide grinding belts are used as the grinding belts.

15. Process as claimed in claim 14, wherein a liquid is supplied to the diamond grinding belts in an area in which the grinding belts engage the edges of the borders of the glass pane.

16. Process as claimed in claim 15, wherein the liquid is water.

17. A process for preparation of glass panes for producing flat glass panes or insulating glass panes, including the steps of:

providing a said glass pane having a plurality of borders, each said border having two edges; and for each said border, simultaneously machining said two edges while the glass pane is oriented essentially vertically;

wherein in a first machining site using a first machining tool adjacent said borders of two glass panes located in one plane are machined simultaneously, and wherein in a second machining site using second and third machining tools, two opposing said borders of one said glass pane are machined simultaneously.

18. A process for preparation of glass panes obtained by cutting glass blanks for producing flat glass panes or insulating glass panes by machining the edges of the borders of said cut glass panes, including the steps of:

providing said glass pane having a plurality of borders, each said border having two edges;

simultaneously machining said two edges of a first said border while the glass pane is held stationary with respect to a base of the machine;

for each of second and third said borders arranged generally perpendicular to the first border, simultaneously machining said two edges while the glass pane is moved with respect to the base of the machine; and simultaneously machining said two edges of a fourth said border generally parallel to the first border while the glass pane is held stationary with respect to a base of the machine.

* * * * *